US010927614B2

(12) United States Patent
Le Roux et al.

(10) Patent No.: US 10,927,614 B2
(45) Date of Patent: Feb. 23, 2021

(54) DRILL PIPE FILL-UP TOOL SYSTEMS AND METHODS

(71) Applicant: Nabors Drilling Technologies USA, Inc., Houston, TX (US)

(72) Inventors: Hendrik Schalk Le Roux, Lafayette, LA (US); Ronald James Scrantz, Breaux Bridge, LA (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 239 days.

(21) Appl. No.: 15/879,229

(22) Filed: Jan. 24, 2018

(65) Prior Publication Data

US 2018/0216422 A1 Aug. 2, 2018

Related U.S. Application Data

(60) Provisional application No. 62/452,251, filed on Jan. 30, 2017.

(51) Int. Cl.

| | |
|---|---|
| ***E21B 19/06*** | (2006.01) |
| ***E21B 21/01*** | (2006.01) |
| ***E21B 21/10*** | (2006.01) |

(52) U.S. Cl.

CPC ..... *E21B 19/06* (2013.01); *E21B 21/01* (2013.01); *E21B 21/106* (2013.01)

(58) Field of Classification Search

CPC ..... E21B 19/06; E21B 19/16; E21B 21/01; E21B 21/106

See application file for complete search history.

(56) References Cited

U.S. PATENT DOCUMENTS

| | | | | |
|---|---|---|---|---|
| 6,779,599 | B2 | 8/2004 | Mullins et al. | |
| 8,141,642 | B2 | 3/2012 | Olstad et al. | |
| 8,316,930 | B2 | 11/2012 | Clubb et al. | |
| 2002/0129934 | A1* | 9/2002 | Mullins | E21B 19/16 166/90.1 |
| 2004/0011566 | A1* | 1/2004 | Lee | E21B 21/103 175/317 |

(Continued)

FOREIGN PATENT DOCUMENTS

WO 2016122922 A1 8/2016

*Primary Examiner* — Christopher J Sebesta

(74) *Attorney, Agent, or Firm* — Abel Schillinger, LLP; Enrique Abarca

(57) ABSTRACT

Present embodiments are directed to systems and methods for efficiently connecting drill pipe (i.e., referred to as the landing string) to a top drive mud line when running liners into a well. For example, in certain embodiments, a drill pipe fill-up tool includes an axially-extendable mud cylinder coupled to an upper mounting plate and a lower mounting plate. The mud cylinder includes a mud cavity configured to be fluidly connected to a mud line of a top drive of drilling system. The drill pipe fill-up tool also includes an actuating cylinder coupled to the upper mounting plate and the lower mounting plate. The actuating cylinder is configured to axially extend the mud cylinder. The drill pipe fill-up tool further includes a seal and guide assembly coupled to the mud cylinder. The seal and guide assembly is configured to engage with a drill pipe and to fluidly connect the mud cavity of the mud cylinder to an interior of the drill pipe.

16 Claims, 11 Drawing Sheets

(56) References Cited

U.S. PATENT DOCUMENTS

| | | | | |
|---|---|---|---|---|
| 2007/0158076 | A1* | 7/2007 | Hollingsworth, Jr. | E21B 19/00 166/379 |
| 2007/0257486 | A1* | 11/2007 | Filippov | E21B 43/106 285/382.2 |
| 2009/0229837 | A1* | 9/2009 | Wiens | E21B 19/06 166/381 |
| 2012/0160517 | A1* | 6/2012 | Bouligny | E21B 3/02 166/380 |
| 2013/0056275 | A1* | 3/2013 | Neidhardt | E21B 19/16 175/57 |
| 2017/0321484 | A1 | 11/2017 | Dewald et al. | |

* cited by examiner

DRILL PIPE FILL-UP TOOL SYSTEMS AND METHODS

CROSS REFERENCE TO RELATED APPLICATION

This application is a U.S. Non-Provisional Patent Application claiming priority to U.S. Provisional Patent Application No. 62/452,251, entitled "DRILL PIPE FILL-UP TOOL SYSTEMS AND METHOD," filed Jan. 30, 2017, which is hereby incorporated by reference in its entirety for all purposes.

BACKGROUND

Embodiments of the present disclosure relate generally to the field of drilling and processing of wells. More particularly, embodiments of the present disclosure are directed to systems and methods for efficiently connecting drill pipe to a top drive mud line when running liners (i.e., casing string that does not extend to the top of the well) into a well.

Top drives are typically utilized in well drilling and maintenance operations, such as operations related to oil and gas exploration. In conventional oil and gas operations, a well is typically drilled to a desired depth with a drill string, which includes drill pipe and a drilling bottom hole assembly (BHA). During a drilling process, the drill string may be supported and hoisted about a drilling rig by a hoisting system for eventual positioning down hole in a well. As the drill string is lowered into the well, a top drive system may rotate the drill string to facilitate drilling.

Once the desired depth is reached, the drill string is removed from the hole, and casing is run into the vacant hole. In some conventional operations, the casing may be installed as part of the drilling process (e.g., casing running). A technique that involves running casing at the same time the well is being drilled may be referred to as "casing-while-drilling." Casing may be defined as pipe or tubular that is placed in a well to prevent the well from caving in, to contain fluids, and to assist with efficient extraction of product. When the casing is run into the well, the casing may be gripped and rotated by a top drive.

BRIEF DESCRIPTION

In accordance with one embodiment of the disclosure, a drill pipe fill-up tool includes an axially-extendable mud cylinder coupled to an upper mounting plate and a lower mounting plate. The mud cylinder includes a mud cavity configured to be fluidly connected to a mud line of a top drive of drilling system. The drill pipe fill-up tool also includes an actuating cylinder coupled to the upper mounting plate and the lower mounting plate. The actuating cylinder is configured to axially extend the mud cylinder. The drill pipe fill-up tool further includes a seal and guide assembly coupled to the mud cylinder. The seal and guide assembly is configured to engage with a drill pipe and to fluidly connect the mud cavity of the mud cylinder to an interior of the drill pipe.

In accordance with another embodiment of the disclosure, a method includes coupling a drill pipe fill-up tool to drill pipe. The method also includes providing mud to an interior of the drill pipe from a mud line of a top drive of a drilling system via a mud cavity of a mud cylinder of the drill pipe fill-up tool. The method further includes adjusting an axial extension of the mud cylinder to adjust an interior volume of the mud cavity of the mud cylinder.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Present embodiments provide a drill pipe fill-up tool that facilitates quick connection of drill pipe to a top drive mud line. When a liner is run into a well, the drill string is typically attached to the end of the liner to lower the liner to the end of the casing where it will be hung off. As the liner is lowered into the well, drilling mud that is in the well may be displaced by the liner. The displaced drilling mud may be pushed up into the drill string bore, may flow out of the top of the drill pipe, and/or may spill onto the drilling rig floor. In an effort to avoid spilling, the displaced mud onto the drilling rig floor, the drill pipe may be connected to the top drive so that the displaced mud may flow through the top drive mud line back to the mud tanks. However, to connect the drill pipe to the top drive, a drill pipe American Petroleum Institute (API) connection may be made up, which may take time. The disclosed drill pipe fill-up tool described herein provides systems and methods for quickly connecting the drill pipe to the top drive mud line without making up an API connection each time a drill pipe joint is added.

Figure 1:
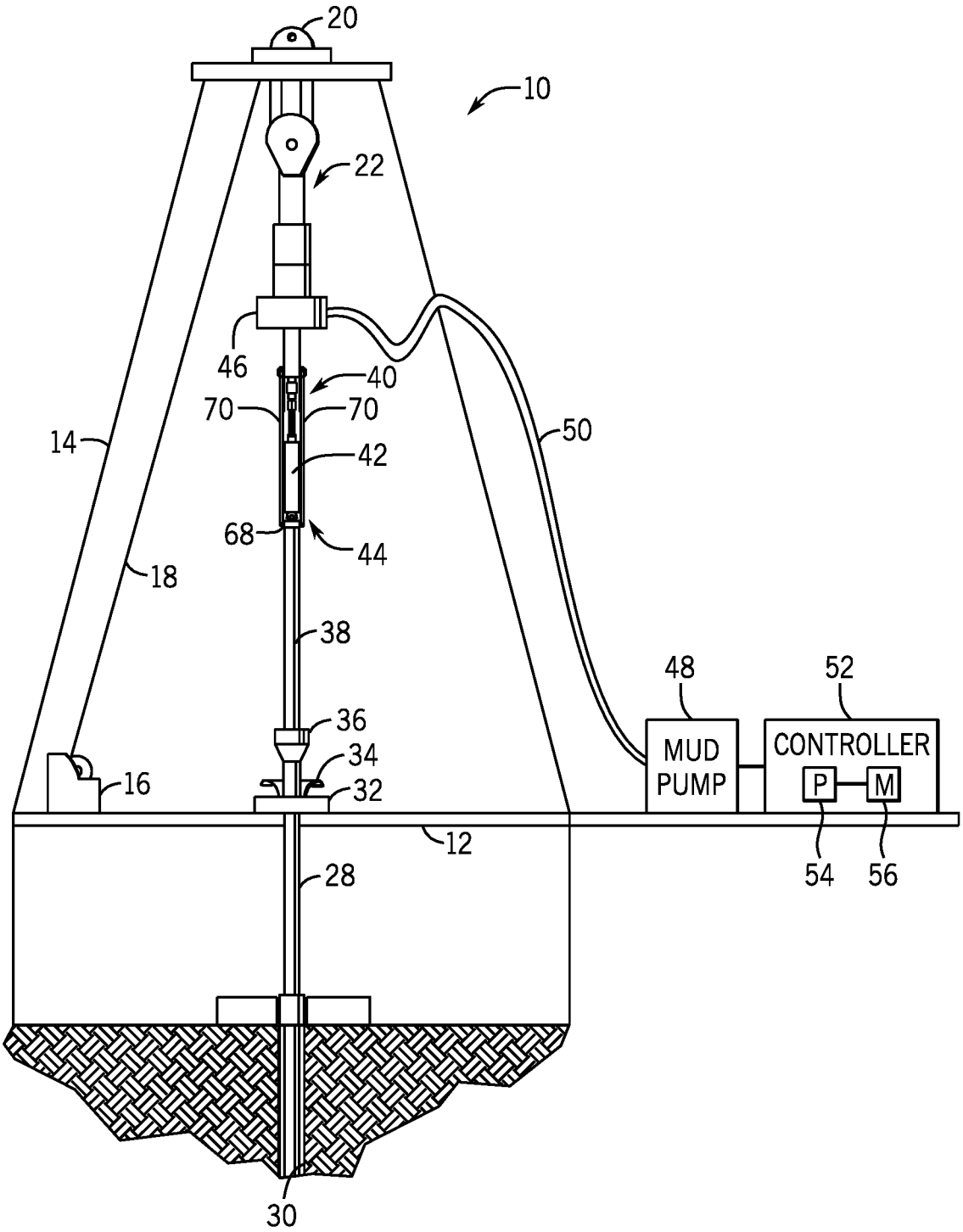
FIG. 1 is a schematic of a drilling rig in the process of drilling a well, in accordance with present techniques.

Turning now to the drawings, FIG. 1 is a schematic of a drilling rig 10 in the process of drilling a well, in accordance with present techniques. While FIG. 1 represents the drilling rig 10 during a drilling process, present embodiments may be utilized for disassembly processes and so forth. In particular, present embodiments may be employed in procedures including assembly or disassembly of drill pipe elements, wherein it is desirable to provide and control an amount of fluid circulation through the drill pipe elements from a drill pipe handling system during assembly or disassembly procedures. Furthermore, present embodiments may be used to provide and control fluid circulation for removing cuttings during drilling of the earth formation and for controlling the well.

In the illustrated embodiment, the drilling rig 10 features an elevated rig floor 12 and a derrick 14 extending above the rig floor 12. A supply reel 16 supplies drilling line 18 to a crown block 20 and traveling block 22 configured to hoist various types of equipment and drill pipe above the rig floor 12. In certain embodiments, the drilling line 18 may be secured to a deadline tiedown anchor. Further, a drawworks may regulate the amount of drilling line 18 in use and, consequently, the height of the traveling block 22 at any given moment. Below the rig floor 12, a drill string 28 extends downward into a wellbore 30 and is held stationary with respect to the rig floor 12 by a rotary table 32 and slips 34. A portion of the drill string 28 extends above the rig floor 12, forming a stump 36 to which another drill pipe element or length of drill pipe 38 is in the process of being added.

The length of drill pipe 38 is suspended from a drill pipe elevator 68 and a set of links (bails) 70, and is held in place by a pipe drive system 40 that is hanging from the traveling block 22. Specifically, a drill pipe fill-up tool 42 of the pipe drive system 40 is configured to engage with a distal axial end 44 of the drill pipe 38. In the illustrated embodiment, the pipe drive system 40 is holding the drill pipe 38 in alignment with the stump 36. The drill pipe fill-up tool 42 may include an integral seal such that a sealed passage is established between the pipe drive system 40 and the drill pipe 38. Establishing this sealed passage facilitates circulation of fluid (e.g., drilling mud) through the pipe drive system 40 into the drill pipe 38 and the drill string 28. While the drill pipe fill-up tool 42 is installed, the pipe drive system 40, which includes a top drive 46, cannot transfer torque to the drill pipe 38. In this case, manual rig tongs or an "iron roughneck" is utilized to make up the connection between drill pipe 38 and the stump 36. In addition, the top drive 46 includes an internal mud line configured to convey mud between a mud pump 48 and the drill pipe fill-up tool 42.

To facilitate the circulation of mud or other drilling fluid within the wellbore 30, the drilling rig 10 includes the mud pump 48 configured to pump mud or drilling fluid up to the pipe drive system 40 through a mud hose assembly 50 (which, in certain embodiments, may include one or more mud hoses, for example, to facilitate bidirectional mud flow). From the pipe drive system 40, the drilling mud will flow through internal passages of the drill pipe fill-up tool 42, into internal passages of the drill pipe 38 and the drill string 28, and into the wellbore 30 to the bottom of the well. The drilling mud flows within the wellbore 30 (e.g., in an annulus between the drill string 28 and the wellbore 30) and back to the surface where the drilling mud may be recycled (e.g., filtered, cleaned, and pumped back up to the pipe drive system 40 by the mud pump 48).

The illustrated embodiment of the drilling rig 10 further includes a controller 52 having one or more microprocessor (s) 54 and a memory 56. The memory 56 is a non-transitory (not merely a signal), computer-readable media, which may include executable instructions that may be executed by the microprocessor(s) 54. The controller 52 is configured to regulate operation of the mud pump 48 and/or other operational components of the drilling rig 10.

Figure 2:
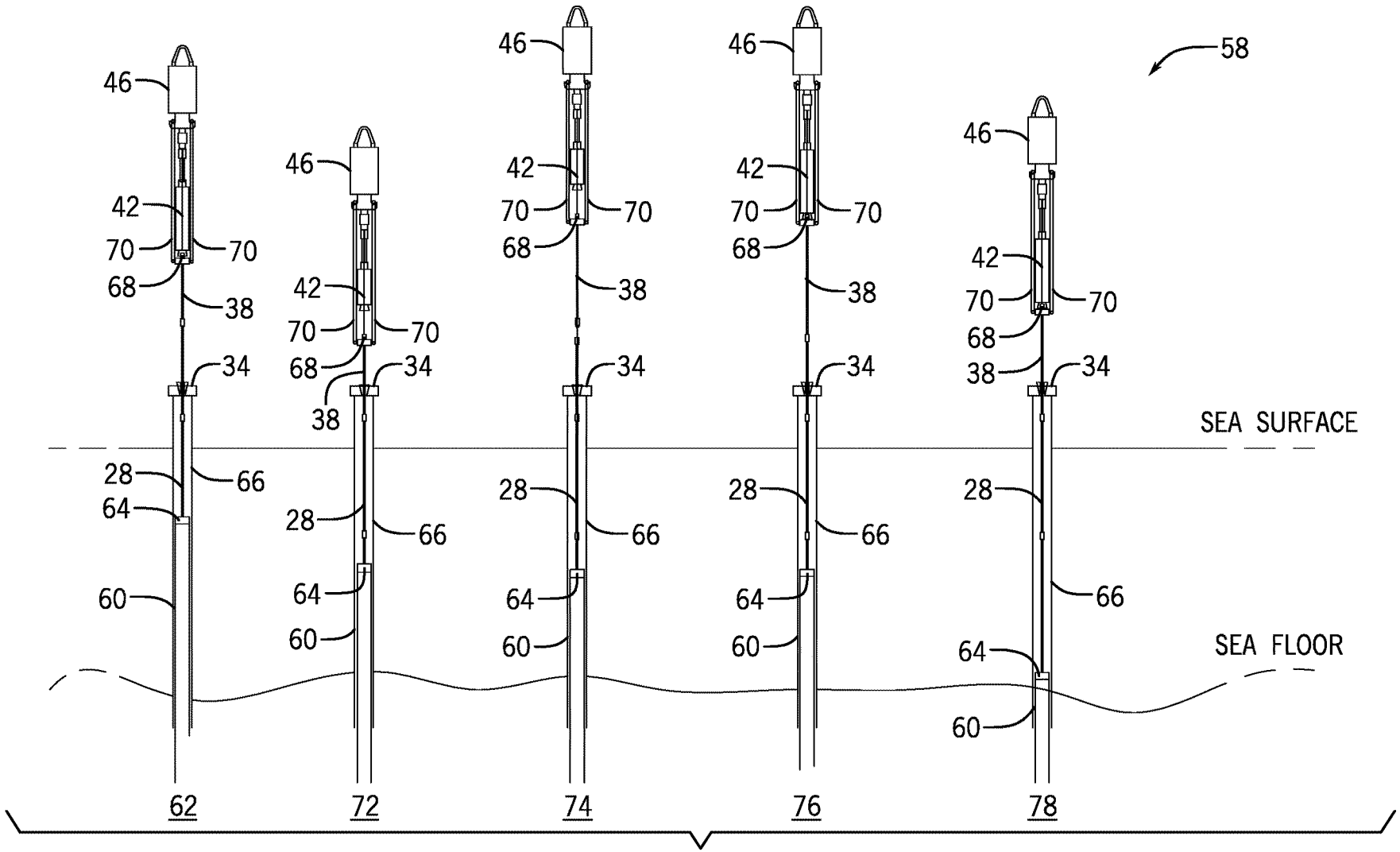
FIG. 2 is an embodiment of an operational sequence used to avoid displaced mud spilling onto the drilling rig floor when a liner is run into the well, in accordance with present techniques.

FIG. 2 is an embodiment of an operational sequence 58 used to avoid displaced mud spilling onto the rig floor 12 when a liner 60 is run into the wellbore 30, in accordance with present techniques. In a first step 62, with the slips 34 open and the drill pipe fill-up tool 42 connected to the drill pipe 38, the drill pipe 38 may be connected to the liner 60 via a drill pipe-to-liner connection 64 and lowered through a riser pipe 66 and into the wellbore 30. The drill pipe 38 may be hanging off of the drill pipe elevator 68, which may be attached to the top drive 46 through bails 70. In certain embodiments, the drill pipe fill-up tool 42 may be installed on the top drive 46 and may be extended to connect to the drill pipe 38. As the liner 60 is lowered into the wellbore 30, the displaced mud may flow back up through the interior of the drill pipe 38, then up through the drill pipe fill-up tool 42, and subsequently flow back to the mud tanks through the mud line of the top drive 46.

In a second step 72, once the joint of drill pipe 38 is run in all the way to the slips 34 (i.e., when the drill string 28 is lowered within the wellbore 30), the slips 34 may be closed to secure the drill pipe 38 in place, the drill pipe fill-up tool 42 may be disconnected from the drill pipe 38 and retracted, and the drill pipe elevator 68 may be unlatched from the joint of drill pipe 38. In a third step 74, with the slips 34 still closed, the top drive 46 may be hoisted and the drill pipe elevator 68 may be latched onto a next joint of drill pipe 38, but the drill pipe fill-up tool 42 remains disconnected from the next joint of drill pipe 38. The next joint of drill pipe 38 may then be lifted from the rack and stabbed into the box end of the stump 36, and a drill pipe joint connection may be made up. In a fourth step 76, the top drive 46 may be hoisted to pick up the string weight, the slips 34 may be opened, and the drill pipe fill-up tool 42 may be extended to make a connection to the next joint of drill pipe 38 (e.g., a distal axial end 44 of the drill pipe 38). In a fifth step 78, with the slips 34 still open, the drill string 28 may be lowered again, and the displaced mud may flow back up through the interior of the drill pipe 38, then up through the drill pipe fill-up tool 42, and subsequently flow back to the mud tanks through the mud line of the top drive 46. With every joint of drill pipe 38 added, this process may be repeated until the liner 60 reaches the hang-off point. Further, the same steps as above may be followed for a fill-up process, except that the mud may be pumped through the drill pipe fill-up tool 42 into the drill pipe 38.

Figure 3:
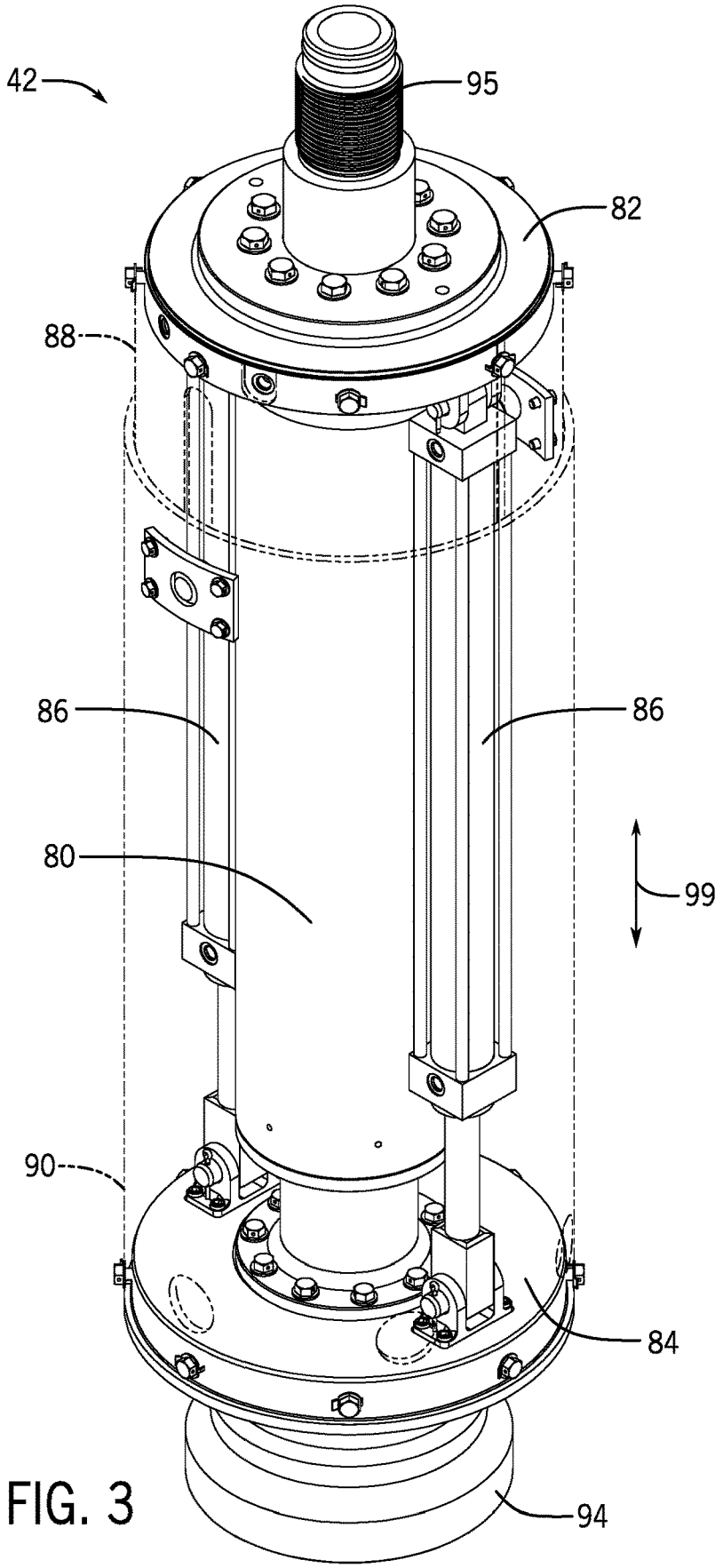
FIG. 3 is a perspective view of an embodiment of a drill pipe fill-up tool, in accordance with present techniques.

FIG. 3 is a perspective view of an embodiment of the drill pipe fill-up tool 42, in accordance with present techniques. In certain embodiments, the drill pipe fill-up tool 42 includes several main components, such as a mud cylinder 80, upper and lower mounting plates 82, 84, hydraulic actuator cylinders 86, inner and outer guards 88, 90, a mud saver valve 92, and a drill pipe seal and guide 94 (which, as described herein, may include a drill pipe seal 100 and a drill pipe guide 102 within which the drill pipe seal 100 is radially disposed, in certain embodiments). The drill pipe fill-up tool 42 may be installed below the top drive 46 and above the drill pipe elevator 68 that may hang on the bails 70. For example, the drill pipe fill-up tool 42 may be connected to the top drive 46 via spacer subs, such as the upper sub-connection 95, which may enable connection of the drill pipe fill-up tool 42 to the top drive 46 (e.g., to enable fluid connection of the mud cylinder 80 with the mud line of the top drive 46). The size (e.g., length) of the spacer subs may be selected so that the drill pipe connection that is in the drill pipe elevator 68 may be within the reach (e.g., stroke) of the drill pipe fill-up tool 42.

In operation, the mud cylinder 80 connects the top drive mud line (e.g., within the top drive 46) to the drill pipe 38, which may be connected to the drill pipe seal and guide 94 of the drill pipe fill-up tool 42. For example, the mud cylinder 80 may contain a cylinder housing 114, a piston assembly 108, and a cylinder rod 110, as described in greater detail herein, for example, with respect to FIG. 5A. The mud cylinder 80 is configured to extend and/or retract (i.e., to be axially extendable) to occupy the space between the top drive 46 and the drill pipe 38, as illustrated by arrow 99. For example, in certain embodiments, the hydraulic actuator cylinders 86 are configured to extend and/or retract the mud cylinder 80 to create an initial seal between the drill pipe 38 and the mud cylinder 80. More specifically, in certain embodiments, as described in greater detail herein, the hydraulic actuator cylinders 86 are coupled to the upper and lower mounting plates 82, 84 at opposite axial ends of the hydraulic actuator cylinders 86, and are configured to adjust an axial distance between the upper mounting plate 82 and the lower mounting plate 84 via actuation of the hydraulic actuator cylinders 86, thereby indirectly extending and/or retracting the mud cylinder 80, which is also coupled to the upper and lower mounting plates 82, 84 at opposite axial ends of the mud cylinder 80. As illustrated, in certain embodiments, the bore of the mud cylinder 80 may be larger than the contact area of the drill pipe seal (e.g., via the drill pipe seal and guide 94). Therefore, once pressure is built up within the mud cylinder 80, it may extend and increase the pressure on the drill pipe seal 100 of the drill pipe seal and guide 94.

Figure 4:
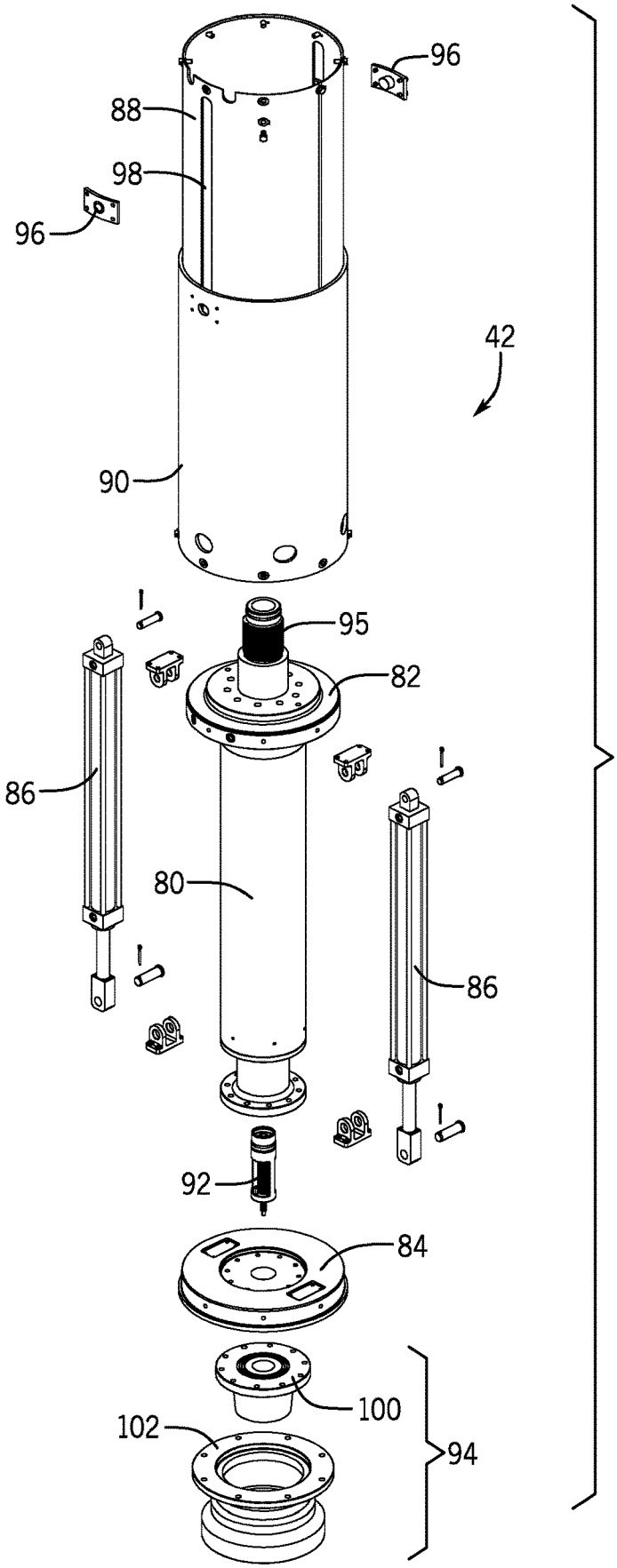
FIG. 4 is an exploded view of an embodiment of the drill pipe fill-up tool, in accordance with present techniques.

In certain embodiments, the upper and lower mounting plates 82, 84 may serve as the mountings for the hydraulic actuator cylinders 86, as well as the mountings for the inner and outer guards 88, 90 and the mud cylinder 80. In other words, in certain embodiments, the mud cylinder 80, the hydraulic actuator cylinders 86, and the inner and outer guards 88, 90 (collectively) are coupled to the upper and lower mounting plates 82, 84 at opposite axial ends of each of these components (i.e., at opposite axial ends of the mud cylinder 80, at opposite axial ends of the hydraulic actuator cylinders 86, and at opposite axial ends of the inner and outer guards 88, 90, when considered collectively). In certain embodiments, the inner and outer guards 88, 90 provide external protection for the mud cylinder 80 and the hydraulic actuator cylinders 86. Further, in certain embodiments, to facilitate the extension and/or retraction of the mud cylinder 80, the inner guard 88 may be configured to telescope within the outer guard 90 (see, e.g., FIGS. 4 and 11). In certain embodiments, as illustrated in FIG. 4, the outer guard 90 may include an anti-rotation mechanism, such as an anti-rotation pin 96 that slides axially within a slot 98 that extends axially through the inner guard 88 to block the outer guard 90 from rotating relative to the inner guard 88 and/or to block the upper and lower mounting plates 82, 84 from rotating relative to each other, thus enabling the hydraulic actuator cylinders 86 to remain aligned (e.g., axially aligned). Further, in certain embodiments, the outer guard 90 and/or inner guard 88 may include markings that show when the drill pipe fill-up tool 42 is extended enough to make a seal with the drill pipe 38 (e.g., via the drill pipe seal 100 of the drill pipe seal and guide 94).

FIG. 4 is an exploded view of an embodiment of the drill pipe fill-up tool 42, in accordance with present techniques. In certain embodiments, the mud saver valve 92 may help prevent mud from flowing back out of the drill pipe fill-up tool 42 when the drill pipe fill-up tool 42 is retracted. In certain embodiments, the mud saver valve 92 may be similar to the mud saver valve described in U.S. Patent Application Publication No. 2017/0321484, filed on May 8, 2017, and assigned to Tesco Corporation, which is hereby incorporated by reference in its entirety. As illustrated in FIG. 4, the mud saver valve 92 may extend into an inner bore of the mud cylinder 80, and may be located close to the drill pipe seal 100 (of the drill pipe seal and guide 94) to minimize the volume of mud that may spill once the connection of the drill pipe fill-up tool 42 to the drill pipe 38 is broken. In particular, the mud saver valve 92 may close the mud path to block mud from flowing out of the drill pipe fill-up tool 42 once the connection between the drill pipe fill-up tool 42 and the drill pipe 38 is broken. The mud saver valve 92 may also enable (and, indeed, regulate) mud to flow in both directions between an interior of the drill pipe 38 and the mud line of the top drive 46. For example, in certain embodiments, the mud saver valve 92 may open when there is a large enough differential pressure across the mud saver valve 92 in either direction. As mentioned above, when the liner 60 and drill pipe 38 are lowered into the wellbore 30, the mud in the wellbore 30 may be displaced. The displaced mud may flow back up through the drill pipe 38 and into the drill pipe fill-up tool 42. The mud saver valve 92 may open by the pressure of the displaced mud, thus enabling the mud to flow back through the drill pipe fill-up tool 42, into the mud line of the top drive 46, and back to the mud tanks. When a new joint of drill pipe 38 is to be installed, the connection between the drill pipe 38 (e.g., drill string 28) and the drill pipe fill-up tool 42 may be broken. In this case, the mud saver valve 92 may block the mud in the mud line of the top drive 46, and in the mud cylinder 80, from flowing back out of the drill pipe fill-up tool 42 and spilling onto the rig floor 12. For example, in certain embodiments, the mud saver valve 92 may be configured to withstand a pressure head of remaining mud within the drill pipe fill-up tool 42 and/or in the mud line of the top drive 46 to block mud from flowing out of the drill pipe fill-up tool 42 after being disconnected from the drill string 28.

Figure 5A:
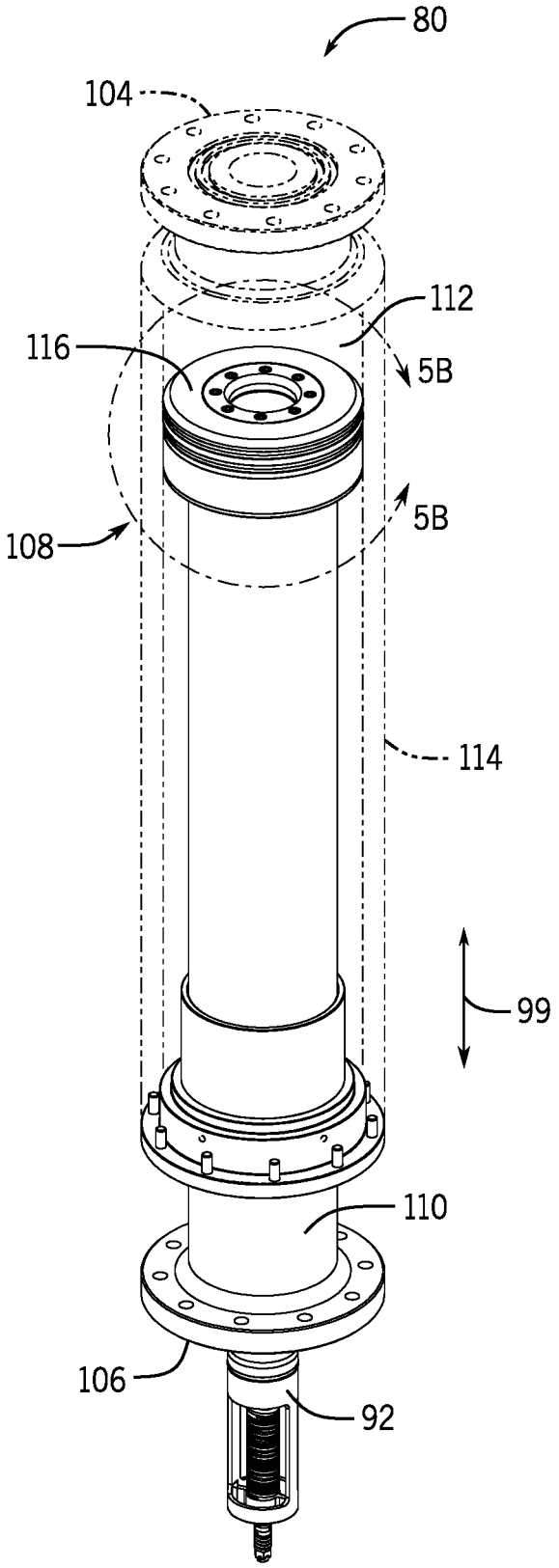
FIG. 5A is a perspective view of an embodiment of a mud cylinder of the drill pipe fill-up tool, in accordance with present techniques.

FIG. 5A is a perspective view of an embodiment of the mud cylinder 80 of the drill pipe fill-up tool 42, in accordance with present techniques. In general, the mud cylinder 80 of the drill pipe fill-up tool 42 provides a mud path for transfer of the displaced mud from an interior of the drill pipe 38 to the mud line of the top drive 46. Upper and lower mounting flanges 104, 106 of the mud cylinder 80 may enable connection of the mud cylinder 80 to the upper and lower mounting plates 82, 84 of the drill pipe fill-up tool 42. As illustrated, in certain embodiments, the upper mounting flange 104 of the mud cylinder 80 may be connected to a cylinder housing 114 of the mud cylinder 80, such that a first axial end of the mud cylinder 80 may be coupled to the upper mounting flange 82 of the drill pipe fill-up tool 42, whereas the lower mounting flange 106 of the mud cylinder 80 may be connected to a cylinder rod 110 of the mud cylinder 80, such that a second axial end (e.g., opposite the first axial end) of the mud cylinder 80 may be coupled to the lower mounting flange 84 of the drill pipe fill-up tool 42.

Figure 5B:
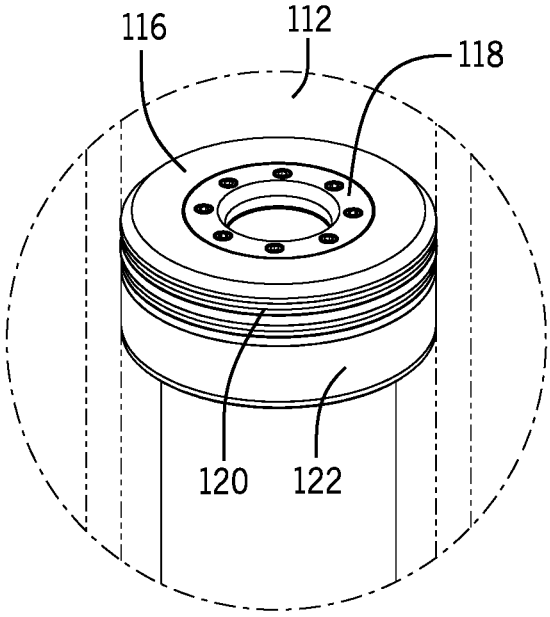
FIG. 5B is a perspective view of a portion of a piston assembly of the mud cylinder of FIG. 5A, in accordance with present techniques.

As described in greater detail herein, the mud cylinder 80 may be axially extendable, and may contain a piston assembly 108 in certain embodiments. The displaced mud may flow from the interior of the drill pipe 38 through an inner bore of the cylinder rod 110 of the mud cylinder 80, and may collect in a mud cavity 112 above the piston assembly 108 (e.g., between the piston assembly 108 and the cylinder housing 114 of the mud cylinder 80). It will be appreciated that axial extension of the mud cylinder 80 increases the interior volume of the mud cavity 112. The mud in the mud cavity 112 above the piston assembly 108 may exert a pressure against the piston assembly 108, which may provide extra force down on the drill pipe seal 100 of the drill pipe seal and guide 94 to maintain the seal between the drill pipe 38 and the drill pipe fill-up tool 42. In certain embodiments, the inner diameter of the mud cylinder 80 may be greater than the diameter of the drill pipe seal 100, which may further provide force on the drill pipe seal 100 to maintain the seal between the drill pipe 38 and the drill pipe fill-up tool 42. FIG. 5B is a perspective view of a portion of the piston assembly 108 of the mud cylinder 80 of FIG. 5A, in accordance with present techniques. As illustrated, the piston 116 of the piston assembly 108 may be associated with a piston retainer 118, piston seals 120, and a wear band 122 configured to minimize wear caused by axial movement of the piston 116 relative to the cylinder housing 114, in certain embodiments.

Figure 6:
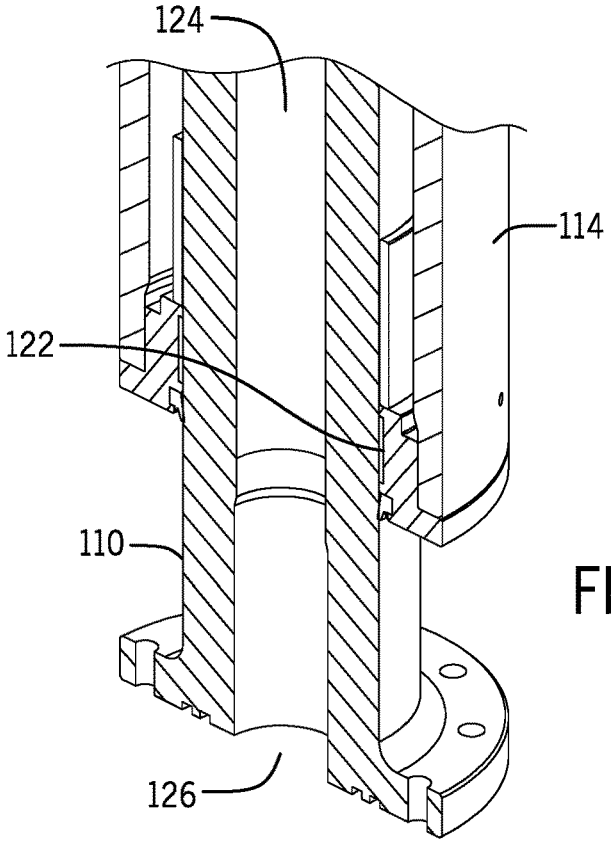
FIG. 6 is a perspective view of an embodiment of a bottom portion of the mud cylinder including a cylinder rod, in accordance with present techniques.

FIG. 6 is a perspective view of an embodiment of the mud cylinder 80, in accordance with present techniques. As illustrated, the cylinder rod 110 may provide a path (e.g., via an inner bore 124) for the displaced mud to flow into the mud cylinder 80 once the pressure of the displaced mud has opened the mud saver valve 92. The mud saver valve 92 may fit into the cylinder rod 110 of the mud cylinder 80 through the inner bore 124 at an axial end 126 of the cylinder rod 110 near the lower mounting flange 106 of the cylinder rod 110. In particular, the mud saver valve 92 may be disposed between the cylinder rod 110 and the drill pipe seal 100 of the drill pipe seal and guide 94. As illustrated, in certain embodiments, a wear band 122 may be disposed radially between the cylinder rod 110 and the cylinder housing 114 to minimize wear caused by axial movement of the cylinder rod 110 relative to the cylinder housing 114.

Figure 7A:
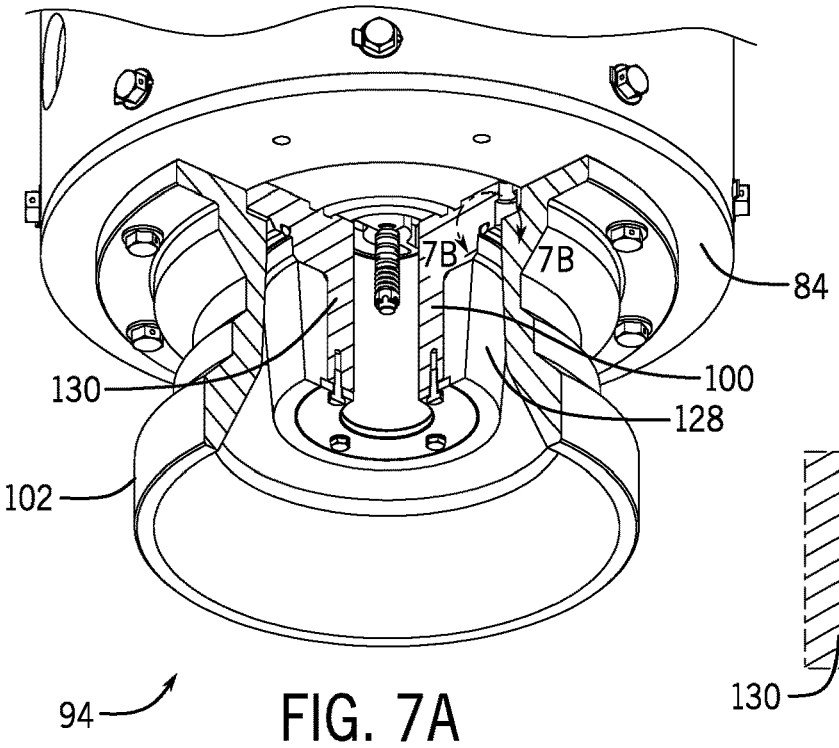
FIG. 7A is cut-away perspective view of an embodiment of a drill pipe seal and guide of the drill pipe fill-up tool, in accordance with present techniques.

FIG. 7A is cut-away perspective view of an embodiment of the drill pipe seal and guide 94 of the drill pipe fill-up tool 42, in accordance with present techniques. The drill pipe fill-up tool 42 may include one or more guides to aid in making up the connection between the drill pipe fill-up tool 42 and the drill pipe 38, such as the drill pipe guide 102 and a thread guide 128. As illustrated, in certain embodiments, the drill pipe seal 100 and the drill pipe guide 102 of the drill pipe seal and guide 94 are each disposed axially adjacent the lower mounting plate 84 of the drill pipe fill-up tool 42, and the drill pipe guide 102 is disposed radially about the drill pipe seal 100. Indeed, in certain embodiments, both the drill pipe seal 100 and the drill pipe guide 102 are configured to be directly connected to the lower mounting plate 84 of the drill pipe fill-up tool 42. During operation, the drill pipe guide 102 may enable an initial alignment of the drill pipe fill-up tool 42 with the drill pipe 38 before the drill pipe seal 100 contacts the drill pipe 38 to block damage to the drill pipe seal 100, whereas the thread guide 128 may enable a final alignment of the drill pipe fill-up tool 42 to the drill pipe 38. As illustrated, in certain embodiments, the drill pipe seal 100 may contain a seal housing 130, wherein a center portion of the seal housing 130 may be connected to the thread guide 128. For example, the thread guide 128 may be disposed radially about the drill pipe seal 100.

Figure 7B:
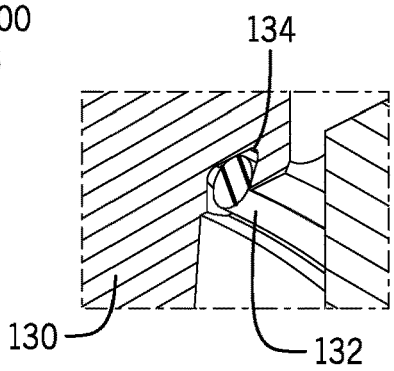
FIG. 7B is a cut-away perspective view of a portion of the drill pipe seal and guide of FIG. 7A, in accordance with present techniques.
Figure 8:
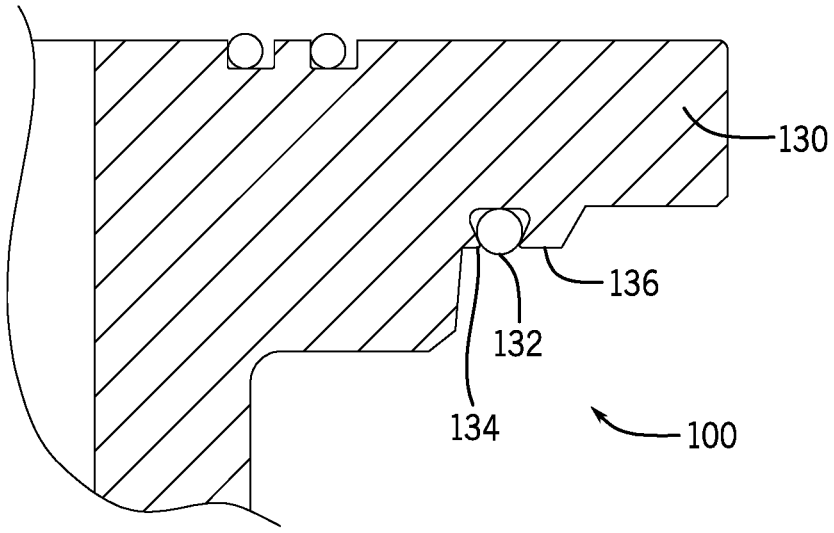
FIG. 8 is a cross-sectional view of an embodiment of the drill pipe seal of the drill pipe fill-up tool, in accordance with present techniques.

FIG. 7B is a cut-away perspective view of a portion of the drill pipe seal and guide 94 of FIG. 7A, in accordance with present techniques. In certain embodiments, the drill pipe seal 100 may include a sealing ring 132 (e.g., an o-ring, in certain embodiments) that is disposed in a groove 134 (e.g., a dovetail groove, in certain embodiments) in the seal housing 130. The groove 134 may aid in keeping the sealing ring 132 in place. To create a seal between the drill pipe 38 and the mud cylinder 80, a seal face 136 of the drill pipe seal 100 may initially be pushed against an axial surface of the drill pipe 38 by the hydraulic actuator cylinders 86, as described herein. For each drill pipe size and type of connection, the drill pipe fill-up tool 42 may include a sealing ring 132, seal housing 130, and/or thread guide 128 that are particularly sized for the drill pipe size and type of connection. Indeed, in certain embodiments, the drill pipe seal 100 and the thread guide 128 of the drill pipe fill-up tool 42 may be interchanged without disassembly of the drill pipe fill-up tool 42. FIG. 8 is a cross-sectional view of an embodiment of the drill pipe seal 100 of the drill pipe fill-up tool 42, in accordance with present techniques. As discussed above, the sealing ring 132 of the drill pipe seal 100 may be located in the groove 134 in the seal housing 130, which may aid in keeping the sealing ring 132 in place.

Figure 9:
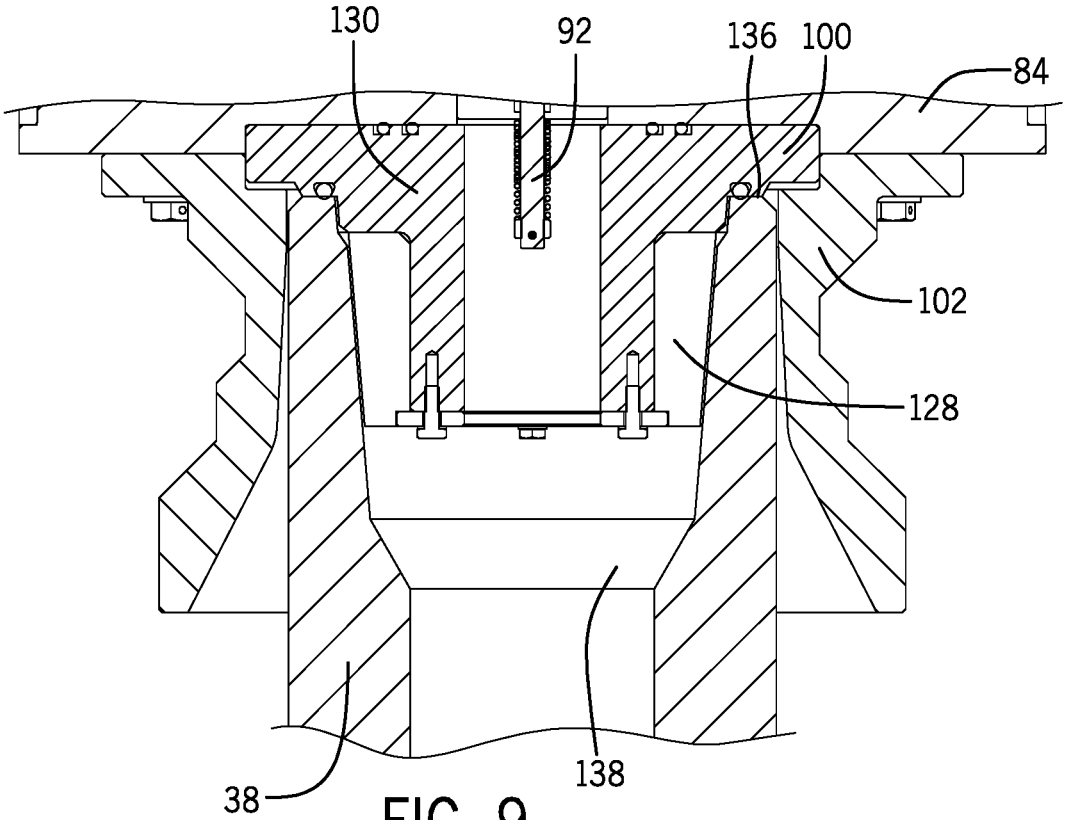
FIG. 9 is a cross-sectional view of an embodiment of a drill pipe connection between the drill pipe fill-up tool and drill pipe, in accordance with present techniques.

FIG. 9 is a cross-sectional view of an embodiment of a drill pipe connection 138 between the drill pipe fill-up tool 42 and the drill pipe 38, in accordance with present techniques. To create a seal between the drill pipe 38 and the seal housing 130 of the drill pipe fill-up tool 42, a seal face 136 of the drill pipe seal 100 may initially be pushed against the drill pipe 38 by actuation of the hydraulic actuator cylinders 86, as described herein. The drill pipe guide 102 and the thread guide 128 of the drill pipe fill-up tool 42 may guide the drill pipe 38 to the seal face 136 of the drill pipe fill-up tool 42 so that the connection between the drill pipe 38 and the drill pipe fill-up tool 42 may be made, as discussed in greater detail with reference to FIG. 10.

Figure 10:
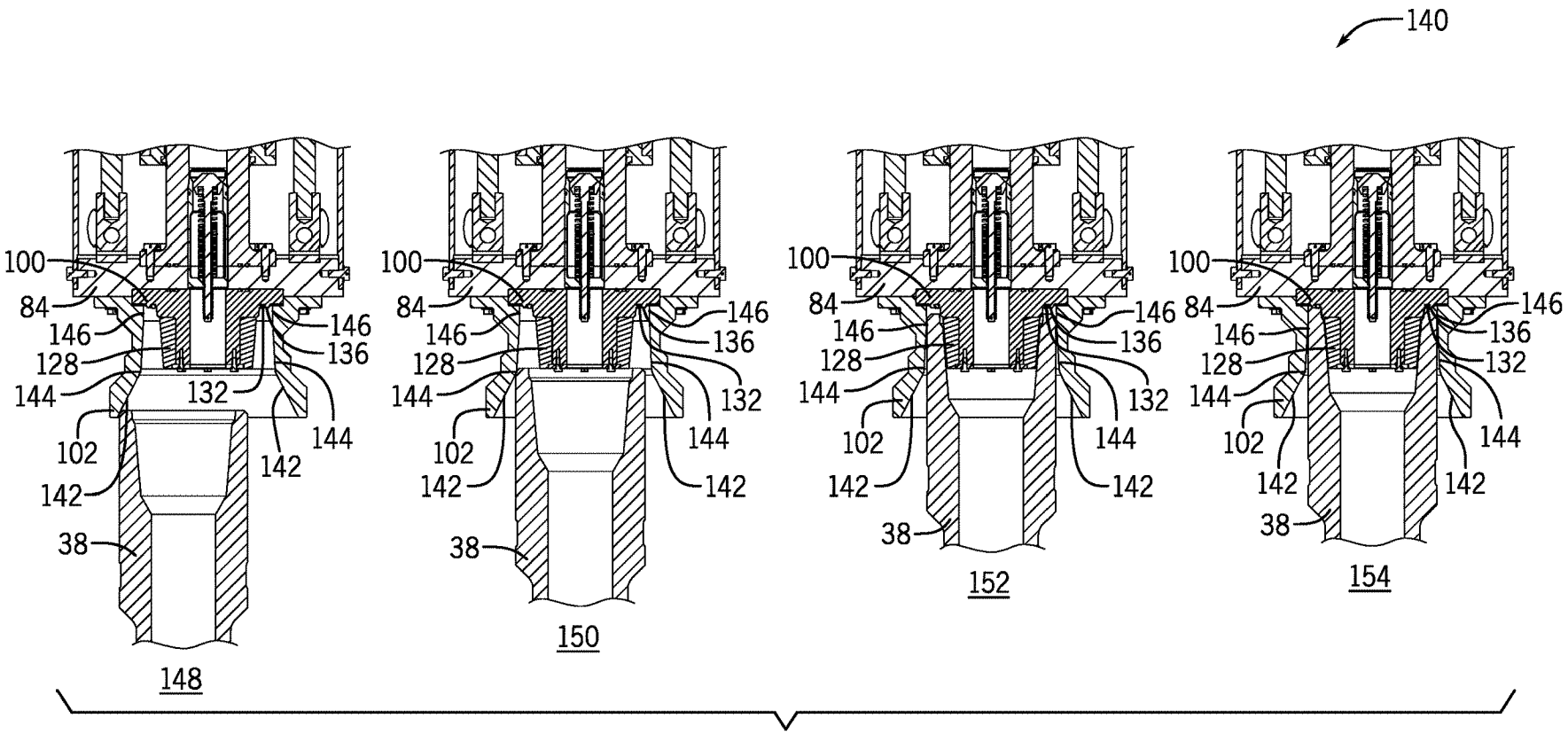
FIG. 10 is an embodiment of an operational sequence of guiding drill pipe to a seal face of the drill pipe fill-up tool to make up a connection between the drill pipe and the drill pipe fill-up tool, in accordance with present techniques.

FIG. 10 is an embodiment of an operational sequence 140 of guiding the drill pipe 38 into abutment with the seal face 136 of the drill pipe fill-up tool 42 to make up a connection between the drill pipe 38 and the drill pipe fill-up tool 42, in accordance with present techniques. As illustrated, in certain embodiments, the drill pipe guide 102 may include several internal tapered surfaces 142, 144, 146 that may act as a rough guide, a finer guide, and a final guide, respectively, to guide the drill pipe 38 to the thread guide 128 of the drill pipe fill-up tool 42. In general, the internal tapered surfaces 142, 144, 146 become increasingly narrower (e.g., form smaller angles with respect to a central longitudinal axis of the drill pipe 38 and the drill pipe fill-up tool 42) closer to the lower mounting plate 84 of the drill pipe fill-up tool 42. For example, a first, relatively wide internal tapered surface 142 of the drill pipe guide 102 may act as a rough guide (e.g., step 148) to position the drill pipe 38 underneath the drill pipe fill-up tool 42. In addition, a second, narrower internal tapered surface 144, which is axially closer to the seal face 136 of the drill pipe seal 100, may act as a finer guide (e.g., step 150) for the drill pipe 38. The finer guide may enable the drill pipe seal 100 to contact only the axial surface of the drill pipe 38, thus aiding in preventing damage to the drill pipe 38 by the axial surface of the drill pipe 38 contacting the thread guide 128. A third, narrowest internal tapered surface 146 may be located adjacent the drill pipe seal 100, and may act as a final guide (e.g., step 152) of the drill pipe 38 onto the thread guide 128. The thread guide 128 may then guide the axial surface of the drill pipe 38 into abutment with the seal face 136 of the drill pipe seal 100 (e.g., step 154).

Figure 11:
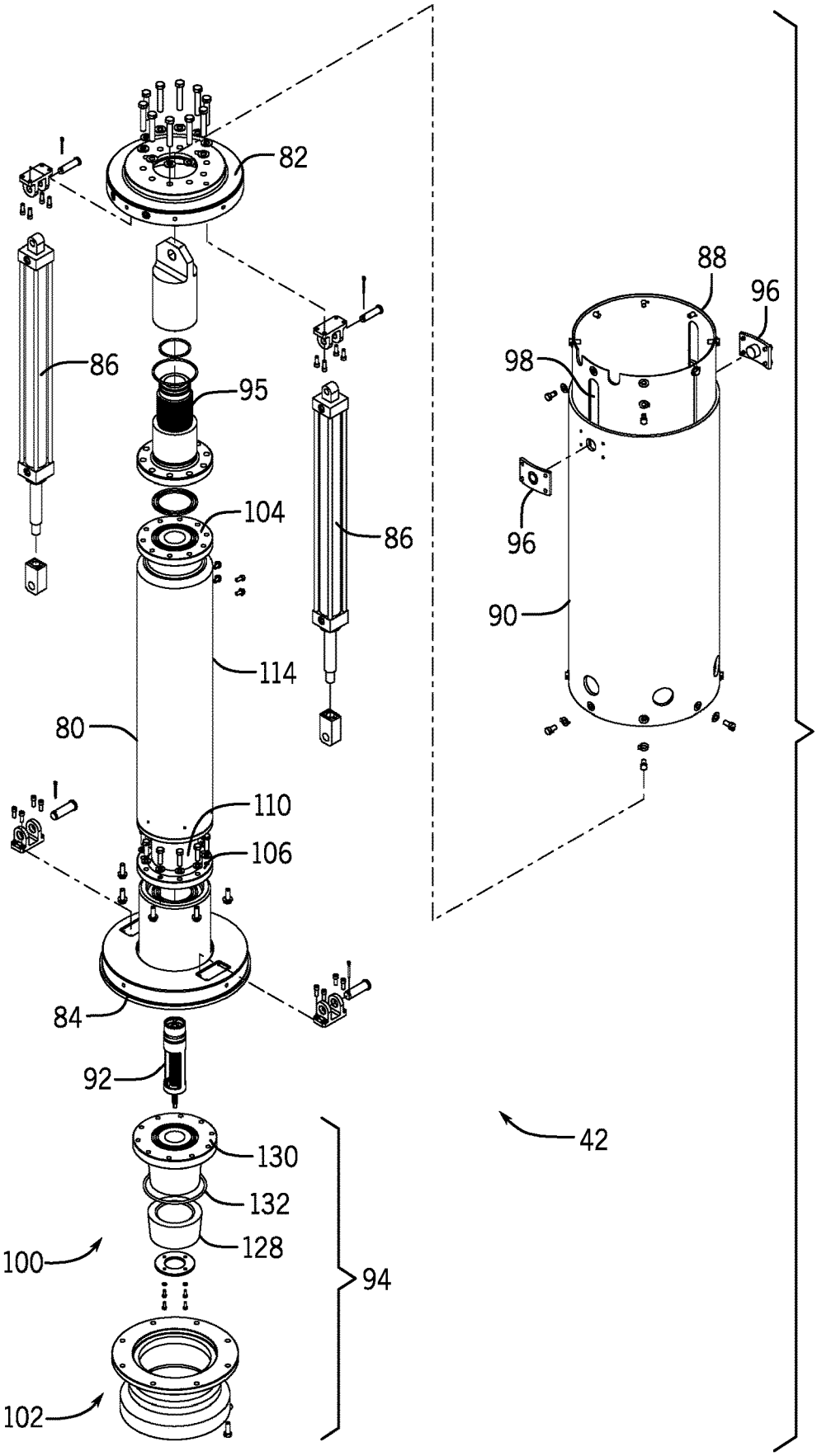
FIG. 11 is an exploded perspective view of the drill pipe fill-up tool, in accordance with present techniques.
Figure 12A:
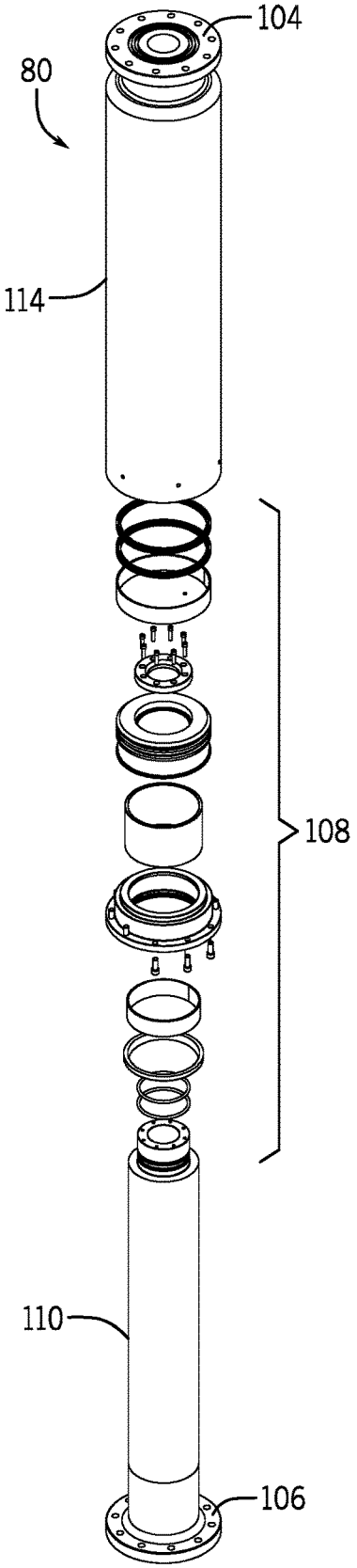
FIG. 12A is an exploded perspective view of an embodiment of the mud cylinder of the drill pipe fill-up tool, in accordance with present techniques.
Figure 12C:
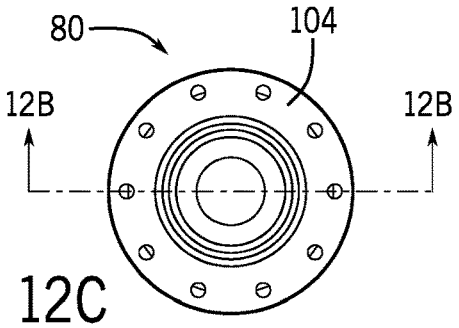
FIG. 12C is a top view of the embodiment of the mud cylinder of FIG. 12A, in accordance with present techniques.
Figure 12B:
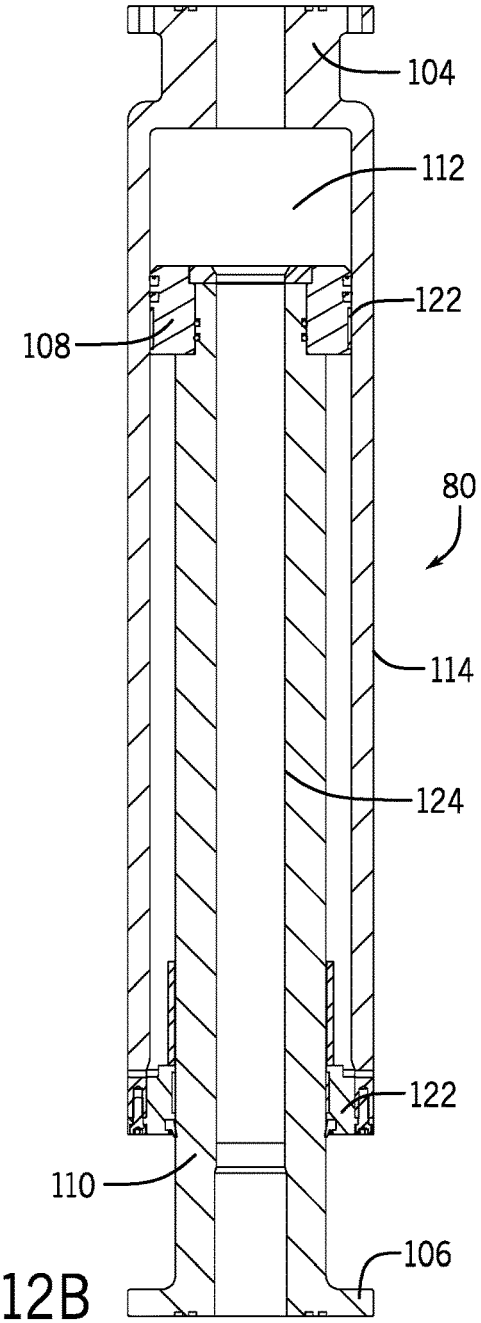
FIG. 12B is a cross-sectional side view of the embodiment of the mud cylinder of FIG. 12A, in accordance with present techniques.
Figure 13A:
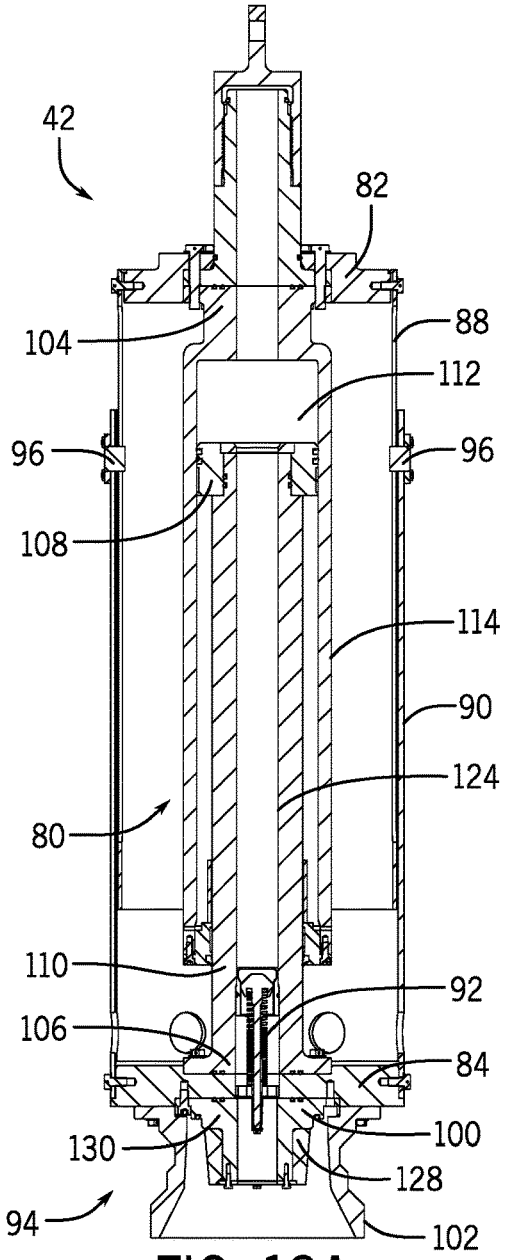
FIGS. 13A-C illustrate various views of an embodiment of the drill pipe fill-up tool, in accordance with present techniques.
Figure 13B:
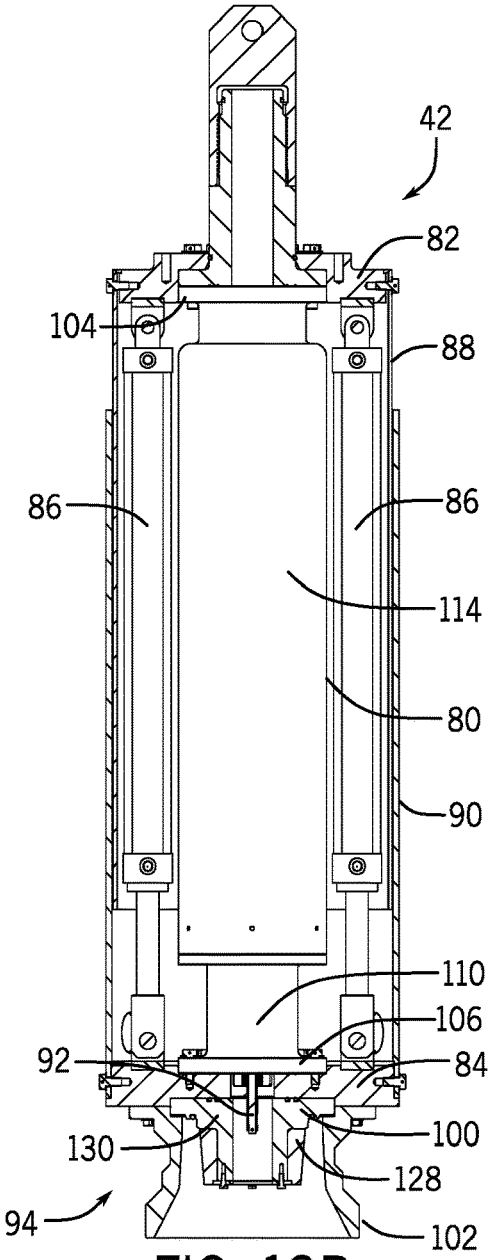
Figure 13C:
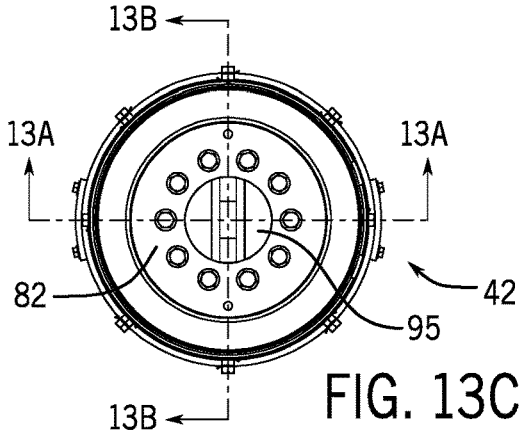

FIGS. 11-13 illustrate additional embodiments and details of the drill pipe fill-up tool 42, in accordance with present techniques. For example, FIG. 11 is an exploded perspective view of the drill pipe fill-up tool 42, illustrating various components of the drill pipe fill-up tool 42 as described herein. In addition, FIG. 12A is an exploded perspective view of an embodiment of the mud cylinder 80 of the drill pipe fill-up tool 42, FIG. 12B is a cross-sectional side view of the embodiment of the mud cylinder 80 of FIG. 12A, and FIG. 12C is a top view of the embodiment of the mud cylinder 80 of FIG. 12A, in accordance with present techniques. In addition, FIGS. 13A-C illustrate various views of an embodiment of the drill pipe fill-up tool 42, in accordance with present techniques.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A drill pipe fill-up tool comprising:

an axially-extendable mud cylinder coupled to an upper mounting plate and a lower mounting plate, wherein the mud cylinder comprises a mud cavity configured to be fluidly connected to a mud line of a top drive of drilling system;

an actuating cylinder coupled to the upper mounting plate and the lower mounting plate, wherein the actuating cylinder is configured to axially extend the mud cylinder; and a seal and guide assembly coupled to the mud cylinder, wherein the seal and guide assembly is configured to engage with a drill pipe and to fluidly connect the mud cavity of the mud cylinder to an interior of the drill pipe, wherein the mud cylinder further comprises a cylinder housing, a cylinder rod disposed within the cylinder housing, and a piston assembly comprising a piston, wherein the mud cavity is in fluid communication with the piston and a longitudinally extending inner bore of the cylinder rod, and wherein the mud cavity is formed between the cylinder housing and the piston assembly.

2. The drill pipe fill-up tool of claim 1, wherein the actuating cylinder is configured to axially extend the mud cylinder by increasing an axial distance between the upper mounting plate and the lower mounting plate.

3. The drill pipe fill-up tool of claim 1, wherein axial extension of the mud cylinder increases an interior volume of the mud cavity.

4. The drill pipe fill-up tool of claim 1, wherein the seal and guide assembly comprises a drill pipe seal and a drill pipe guide, each disposed axially adjacent the lower mounting plate, wherein the drill pipe guide is disposed radially about the drill pipe seal.

5. The drill pipe fill-up tool of claim 4, wherein the drill pipe guide comprises a plurality of internal tapered surfaces configured to guide the drill pipe into abutment against a seal face of the drill pipe seal.

6. The drill pipe fill-up tool of claim 5, wherein the plurality of internal tapered surfaces become increasingly more narrow closer to the lower mounting plate.

7. The drill pipe fill-up tool of claim 5, wherein the drill pipe seal comprises a sealing ring disposed within a dovetail groove, wherein the sealing ring is configured to create a seal with the drill pipe when the drill pipe abuts the seal face.

8. The drill pipe fill-up tool of claim 5, comprising a thread guide disposed radially about the drill pipe seal, wherein the thread guide is configured to guide threads of the drill pipe as the drill pipe guide guides the drill pipe into abutment against the seal face of the drill pipe seal.

9. The drill pipe fill-up tool of claim 1, comprising an inner guard and an outer guard configured to provide external protection for the mud cylinder and the actuating cylinder, wherein the inner guard is coupled to the upper mounting plate, and the outer guard is coupled to the lower mounting plate, and wherein the inner guard is configured to move telescopically within the outer guard.

10. The drill pipe fill-up tool of claim 9, comprising an anti-rotation mechanism configured to block the outer guard from rotating relative to the inner guard.

11. The drill pipe fill-up tool of claim 10, wherein the anti-rotation mechanism comprises a pin of the outer guard configured to slide within an axial slot of the inner guard.

12. The drill pipe of claim 1, wherein the cylinder rod is disposed telescopically within the cylinder housing, and wherein the piston assembly is disposed on an axial end of the cylinder rod within the cylinder housing.

13. The drill pipe fill-up tool of claim 12, wherein the cylinder housing is coupled to the upper mounting plate, and the cylinder rod is coupled to the lower mounting plate.

14. The drill pipe fill-up tool of claim 12, wherein the inner bore of the cylinder rod establishes a fluid connection between the mud cavity and the seal and guide assembly.

15. The drill pipe fill-up tool of claim 12, comprising a valve configured to regulate a flow of mud into and out of the mud cylinder.

16. The drill pipe fill-up tool of claim 15, wherein the valve is disposed between the cylinder rod and the seal and guide assembly.

* * * * *